US006943815B2

(12) United States Patent
Machida et al.

(10) Patent No.: US 6,943,815 B2
(45) Date of Patent: Sep. 13, 2005

(54) THERMAL PRINTER AND ELECTROMAGNETIC WAVE SOURCE DEVICE

(75) Inventors: Akihiko Machida, Saitama (JP); Nobuo Katsuma, Saitama (JP); Kenichi Inatsuki, Saitama (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/375,363

(22) Filed: Feb. 28, 2003

(65) Prior Publication Data

US 2003/0164872 A1 Sep. 4, 2003

(30) Foreign Application Priority Data

Mar. 1, 2002 (JP) ..... 2002-056368
Jul. 8, 2002 (JP) ..... 2002-199183
Jul. 9, 2002 (JP) ..... 2002-199971

(51) Int. Cl.[7] ..... B41J 2/32
(52) U.S. Cl. ..... 347/175
(58) Field of Search ..... 347/175, 172–174; 400/120.01, 120.02, 120.03

(56) References Cited

U.S. PATENT DOCUMENTS 5,463,417 A * 10/1995 Yamakawa ..... 347/212
6,084,624 A * 7/2000 Yamakawa ..... 347/175
6,181,359 B1 * 1/2001 Nakanishi ..... 347/175
6,414,703 B1 * 7/2002 Sugiyama et al. ..... 347/175
2003/0151656 A1 * 8/2003 Kokubo et al. ..... 347/175

FOREIGN PATENT DOCUMENTS

EP 0111297 * 6/1984 ..... B41J/3/20
JP 1-159628 * 6/1989 ..... B41J/3/20
JP 11-058798 * 3/1999 ..... B41J/2/32
JP 2001-155688 * 6/2001 ..... B41J/2/32
JP 2001-171157 A 6/2001
JP 2004-050696 * 2/2004 ..... B41M/5/26

* cited by examiner

*Primary Examiner*—Huan Tran
(74) *Attorney, Agent, or Firm*—Sughrue Mion, PLLC

(57) ABSTRACT

A thermal printer in which color thermosensitive recording material is used is provided. A thermal head records an image to the recording material by applying heat thereto. One or two photo fixing xenon flash lamps apply electromagnetic rays to the recording material, to fix the image. The electromagnetic rays are emitted in the first and second wavelength ranges, and are ultraviolet or visible. A controller changes over electromagnetic rays received by the recording material from the xenon flash lamps. The controller, when in a first step, sets the electromagnetic rays in the first wavelength range by means of a UV absorbing filter, to fix a first coloring layer for yellow. In a second step next to the first, the electromagnetic rays are set in the second wavelength range, to fix a second coloring layer for magenta.

26 Claims, 13 Drawing Sheets

THERMAL PRINTER AND ELECTROMAGNETIC WAVE SOURCE DEVICE

BACKGROUND OF THE INVENTION

1. Field of the Invention

The present invention relates to a thermal printer and electromagnetic wave source device. More particularly, the present invention relates to a thermal printer in which images on thermosensitive recording material are fixed by a photo fixer with electromagnetic rays, and efficiency in the fixation can be prevented from influence of degradation of the photo fixer, and electromagnetic wave source device for emitting such electromagnetic rays.

2. Description Related to the Prior Art

A color thermal printer of a direct printing type is known, and used with color thermosensitive recording material. The recording material includes a support and three thermosensitive coloring layers overlaid thereon for primary colors. The coloring layers are a first, second and third coloring layers in an order toward the support. The first coloring layer has the highest heat sensitivity, and develops its color in response to application of relatively low heat energy. The third coloring layer has the lowest heat sensitivity, and develops its color in response to application of relatively high heat energy. The coloring ability of the first and second coloring layers is destroyed upon application of visible or ultraviolet rays with particular wavelengths. When the recording material is transported, a thermal head is operated to heat and pressurize the recording material, the thermal head extending in a direction crosswise to the transport. So colors are developed in the coloring layers by the thermal recording. After this, a photo fixer is operated to apply violet or ultraviolet rays to the recording material. Before printing to the second coloring layer, the first coloring layer is fixed electromagnetically. Before printing to the third coloring layer, the second coloring layer is fixed similarly. This is to suppress further development of the colors in the first and second coloring layers after intended coloring.

As an electromagnetic wave source for the photo fixer, a mercury fluorescent lamp of a straight tube type is used widely. The mercury fluorescent lamp includes a glass tube and a pair of electrodes. The glass tube is provided with gaseous mercury enclosed therein, and has fluorescent film that is a coating of phosphor. The electrodes are located at ends of the glass tube. When electric current flows to the electrodes, thermal electron is emitted from the electrodes. The electron excites the gaseous mercury to generate ultraviolet rays. The phosphor receives the ultraviolet rays, and responsively violet or ultraviolet rays are emitted to the outside. It is possible with the mercury fluorescent lamp to emit rays continuously. This is typically because energy efficiency of the mercury fluorescent lamp is comparably high. The phosphor in the mercury fluorescent lamp can be constructed in a manner suitable for continuous emission of rays.

However, it is well-known that degradation occurs in the mercury fluorescent lamp to lower an amount of electromagnetic rays after long use. If high energy is applied to the mercury fluorescent lamp in this state, no strong rays are emitted. To compensate for this low performance in view of sufficient fixation, it is necessary to lower a feeding speed of the recording material relative to the mercury fluorescent lamp. This control of changing the feeding speed has problems in elongation of the time required for the photo fixation, to cause low efficiency in the printing operation.

SUMMARY OF THE INVENTION

In view of the foregoing problems, an object of the present invention is to provide a thermal printer in which images on thermosensitive recording material are fixed by a photo fixer with electromagnetic rays, and efficiency in the fixation can be prevented from influence of degradation of the photo fixer, and electromagnetic wave source device for emitting such electromagnetic rays.

In order to achieve the above and other objects and advantages of this invention, a thermal printer in which thermosensitive recording material is used includes a thermal head for recording an image to the recording material by applying heat thereto. At least one photo fixing xenon lamp applies electromagnetic rays to the recording material, to fix the image.

The recording material is color thermosensitive recording material, and includes a support, and at least first, second and third coloring layers, overlaid on the support, positioned in sequence from a printing surface toward the support, for developing respectively a predetermined color upon being heated. The electromagnetic rays are adapted to fix at least one of the first and second coloring layers.

The electromagnetic rays include ultraviolet rays or visible violet rays.

The first coloring layer is fixable upon application of the electromagnetic rays in a first wavelength range, and the second coloring layer is fixable upon application of the electromagnetic rays in a second wavelength range. The photo fixing xenon lamp emits the electromagnetic rays in at least the first and second wavelength ranges. Furthermore, a fixation changeover unit operates in a first step and a second step succeeding thereto, to change over the electromagnetic rays received by the recording material from the photo fixing xenon lamp, the fixation changeover unit operating in the first step, for setting the electromagnetic rays in the first wavelength range, to fix the first coloring layer, and operating in the second step, for setting the electromagnetic rays in at least the second wavelength range, to fix the second coloring layer.

The fixation changeover unit includes a filter, used in the first step, for absorbing a component of the second wavelength range in the electromagnetic rays, and for transmitting a component of the first wavelength range therein.

The component of the second wavelength range is ultraviolet, the second wavelength range has a shorter wavelength than the first wavelength range, and the filter is a UV absorbing filter.

The predetermined color of the first, second and third coloring layers is respectively yellow, magenta and cyan colors.

Furthermore, an irradiance sensor measures irradiance of the electromagnetic rays applied to the recording material. A controller controls the electromagnetic rays to be emitted by the photo fixing xenon lamp according to the measured irradiance obtained by the irradiance sensor.

The photo fixing xenon lamp is a xenon flash lamp for repeated flash emission of the electromagnetic rays at a predetermined frequency. The controller divides a predetermined target irradiance by the measured irradiance, to obtain an irradiance ratio, multiplies the predetermined frequency by the irradiance ratio, to obtain an adjusted frequency, and drives the xenon flash lamp at the adjusted frequency, to set the electromagnetic rays at the target irradiance on the recording material.

In a preferred embodiment, furthermore, a feeder feeds the recording material relative to the thermal head and the photo fixing xenon lamp. The controller divides a predetermined target irradiance by the measured irradiance, to obtain an irradiance ratio, multiplies a present feeding speed of the feeder by the irradiance ratio, to obtain an adjusted feeding speed, and drives the feeder at the adjusted feeding speed, to set the electromagnetic rays at the target irradiance on the recording material.

In another preferred embodiment, the at least one photo fixing xenon lamp comprises first and second lamps the filter is disposed in front of the first lamp. The fixation changeover unit further includes a controller for driving the first lamp in the first step, and for driving the second lamp in the second step.

In a further preferred embodiment, the controller drives the first lamp further in the second step. The fixation changeover unit further includes a moving mechanism for moving the filter, to set the filter in front of the first lamp in the first step, and to offset the filter from a front of the first lamp in the second step.

Furthermore, a reflector is disposed behind the second lamp, has a reflection surface for reflecting electromagnetic rays in a forward direction upon emission from a rear portion of the second lamp. Phosphor is disposed on at least a portion of the reflection surface, for converting a component of one predetermined wavelength range of the electromagnetic rays into electromagnetic rays of the second wavelength range, to raise electromagnetic irradiance in the second step, wherein the predetermined wavelength range is different from the second wavelength range.

In another preferred embodiment, the fixation changeover unit further includes a moving mechanism for moving the filter, to set the filter in front of the photo fixing xenon lamp in the first step, and to offset the filter from a front of the photo fixing xenon lamp in the second step.

In still another preferred embodiment, the fixation changeover unit further includes a first feeding path, disposed in front of the photo fixing xenon lamp and the filter, for passing the recording material. A second feeding path is disposed between the photo fixing xenon lamp and the filter, for passing the recording material. A changeover mechanism guides the recording material from the thermal head into the first feeding path in the first step, and guides the recording material from the thermal head into the second feeding path in the second step.

According to another aspect of the invention, a thermal printer includes a first electromagnetic wave source for emitting the electromagnetic rays in at least the first and second wavelength ranges. A second electromagnetic wave source emits the electromagnetic rays in at least the second wavelength range. A filter absorbs a component of the second wavelength range in the electromagnetic rays, and transmits a component of the first wavelength range therein. A moving mechanism moves the filter relative to a front position in front of the first electromagnetic wave source. A fixation changeover unit operates in a first step and a second step succeeding thereto, to control the first and second electromagnetic wave sources and the moving mechanism, the fixation changeover unit operating in the first step, for setting the filter in front of the first electromagnetic wave source, and for driving the first electromagnetic wave source to fix the first coloring layer, and operating in the second step, for offsetting the filter from the front position of the first electromagnetic wave source, and for driving the first and second electromagnetic wave sources to fix the second coloring layer.

The first and second electromagnetic wave sources include respectively first and second lamps.

The first and second lamps are xenon flash lamps.

The component of the second wavelength range is ultraviolet, the second wavelength range has a shorter wavelength than the first wavelength range, and the filter is a UV absorbing filter.

Furthermore, an irradiance sensor measures irradiance of the electromagnetic rays applied to the recording material. A controller controls the electromagnetic rays to be emitted by the first and second lamps according to the measured irradiance obtained by the irradiance sensor.

According to still another aspect of the invention, an electromagnetic wave source device is provided, and includes an electromagnetic wave source for emitting electromagnetic rays in at least first and second wavelength ranges. A reflector is disposed behind the electromagnetic wave source, has a reflection surface for reflecting electromagnetic rays in a forward direction upon emission from a rear portion of the electromagnetic wave source. Phosphor is disposed on at least a portion of the reflection surface, for converting a component of the first wavelength range of the electromagnetic rays into electromagnetic rays of the second wavelength range, to raise electromagnetic irradiance in the second wavelength range.

The electromagnetic wave source includes a lamp.

The reflector has a U-shape as viewed in section, and includes a curved portion disposed to extend along at least a portion of a periphery of the lamp. First and second front edge portions are disposed to extend in the forward direction from first and second edges of the curved portion, and inclined in directions away from one another with reference to the forward direction.

The electromagnetic rays of the first wavelength range are ultraviolet, the first wavelength range has a shorter wavelength than the second wavelength range.

The lamp is a xenon flash lamp.

The phosphor comprises photo-stimulated luminescence (PSL) material.

The phosphor is disposed on the first and second front edge portions coated therewith.

The reflector includes a first portion and a second portion, secured to the first portion, and coated with the phosphor.

The first portion is the curved portion, and the second portion comprises the first and second front edge portions.

The electromagnetic wave source is adapted for photo fixation of color thermosensitive recording material, the recording material including a support, and at least first, second and third coloring layers, overlaid on the support, positioned in sequence from a printing surface toward the support, for developing respectively a predetermined color upon being heated. One of the first and second coloring layers is fixable upon application of the electromagnetic rays in the second wavelength range.

BRIEF DESCRIPTION OF THE DRAWINGS

The above objects and advantages of the present invention will become more apparent from the following detailed description when read in connection with the accompanying drawings, in which.

DETAILED DESCRIPTION OF THE PREFERRED EMBODIMENT(S) OF THE PRESENT INVENTION

Figure 1A:
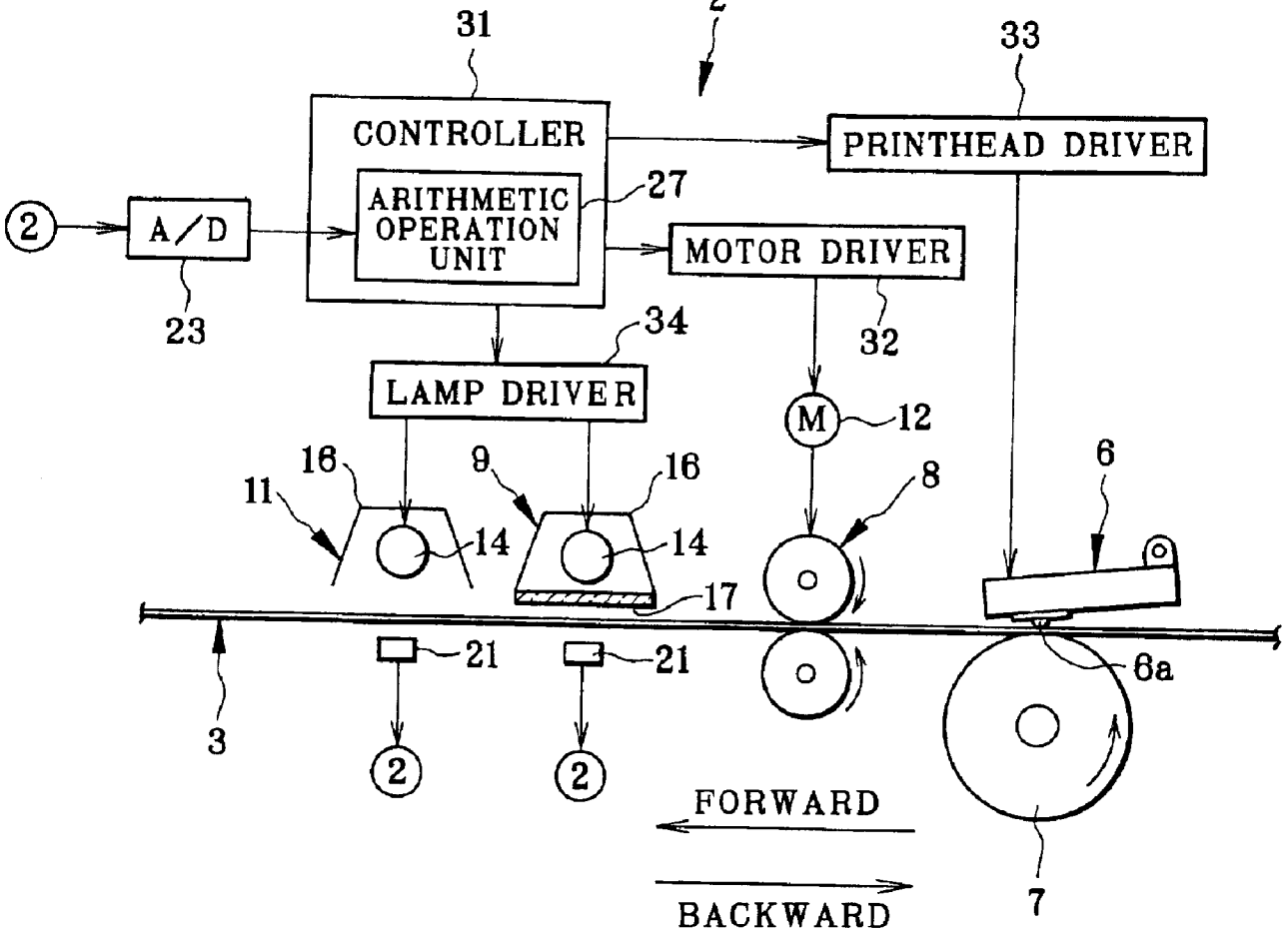
FIG. 1A is an explanatory view in elevation, illustrating a thermal printer of the invention.

In FIG. 1A, a color thermal printer 2 is used with color thermosensitive recording material 3, which is transported in a forward direction and a backward direction, for thermal recording of a full-color image on the recording material 3 and for photo fixation of the recording material 3.

Figure 1B:
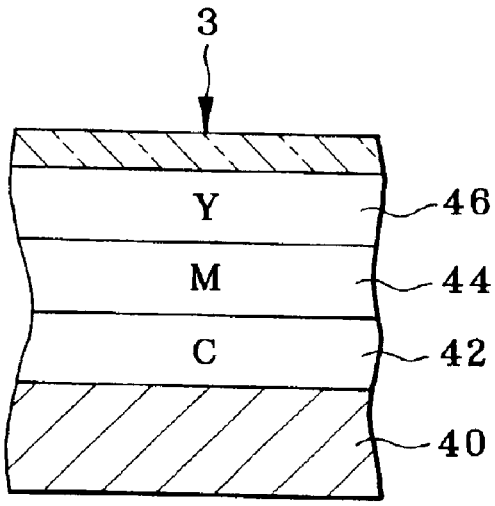
FIG. 1B is an explanatory view in section illustrating layered structure of color thermosensitive recording material.

In FIG. 1B, the recording material 3 includes a support 40 and three thermosensitive coloring layers overlaid thereon. The coloring layers are a yellow coloring layer 46, a magenta coloring layer 44 and a cyan coloring layer 42 in an order toward the support 40. The yellow coloring layer 46 is close to a printing surface. The yellow coloring layer 46 has the highest heat sensitivity, and develops a yellow color in response to application of relatively low heat energy. The cyan coloring layer 42 has the lowest heat sensitivity, and develops a cyan color in response to application of relatively high heat energy. The coloring ability of the yellow coloring layer 46 is destroyed upon application of near ultraviolet rays or violet visible rays with a wavelength of approximately 420 nm. The magenta coloring layer 44 develops color upon application of heat energy at a level between those for the yellow coloring layer 46 and the cyan coloring layer 42. The coloring ability of the magenta coloring layer 44 is destroyed upon application of ultraviolet rays with a wavelength of approximately 365 nm. Also, it is possible for the recording material 3 to include a black coloring layer and to have a four-layered structure.

A thermal head 6 or printhead, and a platen roller 7 are disposed in a feeding path for the recording material 3. The platen roller 7 is opposed to the thermal head 6, and supports the recording material 3. A heating element array 6*a* is included in the thermal head 6 as well-known in the art, and has a number of heating elements arranged in a main scan direction. The heating elements generate heat energy according to density of pixels, and record yellow, magenta and cyan colors to the coloring layers.

A feeding roller set 8 as feeder is disposed in a feeding path and positioned downstream from the thermal head 6. Also, there are a yellow photo fixer 9 and a magenta photo fixer 11. The feeding roller set 8 nips the recording material 3 and feeds the same in the sub scan direction. A feeding motor 12 causes the feeding roller set 8 to rotate.

During the feeding, the recording material 3 is moved past the thermal head 6 and the yellow and magenta photo fixers 9 and 11 for thermal recording and photo fixation. After this, the recording material 3 is cut at a regular size by a cutter (not shown), so print sheets are obtained and exited from the inside of the thermal printer 2.

An example of the feeding motor 12 is a stepping motor which rotates at a regular amount determined according to drive pulses supplied thereto. To control the feeding amount of the recording material 3, the number of the drive pulses supplied to the feeding motor 12 are counted. The recording material 3 is fed at a constant speed which is predetermined suitably.

Each of the yellow and magenta photo fixers 9 and 11 includes a xenon (Xe) flash lamp 14 as photo fixing xenon lamp. A reflector 16 is disposed close to the xenon flash lamp 14, and reflects electromagnetic rays from the xenon flash lamp 14 and directs those to a printing surface of the recording material 3.

The xenon flash lamp 14 includes a glass tube and two electrodes as is well-known in the art. The glass tube contains xenon (Xe) gas enclosed therein. The electrodes are disposed at ends of the glass tube. In the xenon flash lamp 14, high voltage is applied across the end electrodes in response to a trigger signal, to discharge the glass tube for emitting flash light. The flash light has a wide region constituted by various components which include visible rays and ultraviolet rays. The xenon flash lamp 14 is unlike a mercury fluorescent lamp, and will not emit light continuously. To use the xenon flash lamp 14 as a photo fixing electromagnetic wave source, the xenon flash lamp 14 is caused to emit intermittently and periodically at a certain flashing frequency.

Also, the mercury fluorescent lamp has a shortcoming in that an amount of emitted rays depends the temperature because of the use of liquid mercury at the room temperature. With the mercury fluorescent lamp, long time is required until predetermined amount or intensity of rays is obtained after turning on. In contrast, the xenon flash lamp 14 includes xenon that is gaseous at the room temperature. An amount of emitted rays does not depend on the temperature to a high extent. There is an advantage in that desired intensity of rays can be obtained immediately upon being turned on.

The use of the xenon flash lamp 14 as a fixing electromagnetic wave source makes it possible not to use a mercury fluorescent lamp. An intended amount of electromagnetic rays can be obtained throughout the use of the thermal printer with durability without adjusting the feeding speed of the recording material 3.

It is certain that irradiance of the xenon flash lamp 14 at each one time of turning on for flashing becomes lower gradually due to degradation with time. The life of the xenon flash lamp 14 depends upon the number of times of turning on. Even if the irradiance of each one time of turning on becomes lower, it is possible to shorten the frequency of turning on to raise the number of times of turning on, so as to obtain a predetermined intensity per unit time, because the energy is increased. Accordingly, it is unnecessary with the xenon flash lamp 14 to lower the feeding speed of the recording material 3 for the purpose of obtaining the desired intensify even when degradation has occurred.

Figure 2:
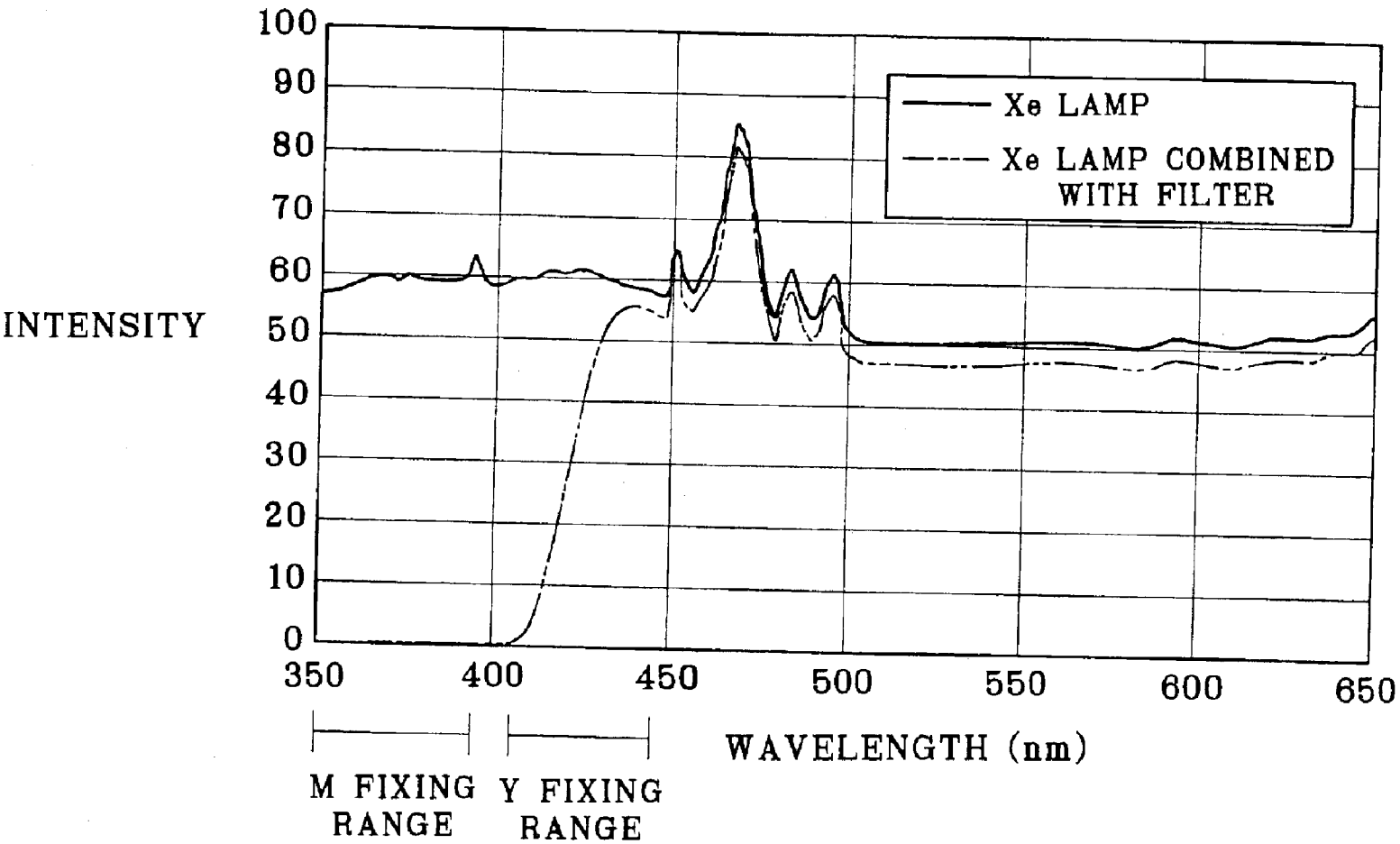
FIG. 2 is a graph illustrating spectral distribution of photo fixing electromagnetic rays.

In FIG. 2, spectral distribution of electromagnetic rays from the xenon flash lamp 14 is illustrated. The xenon flash lamp 14 has a flat or broad spectral distribution in a range of 350–450 nm. The xenon flash lamp 14 can be used for fixing both of the yellow and magenta colors.

Figure 3:
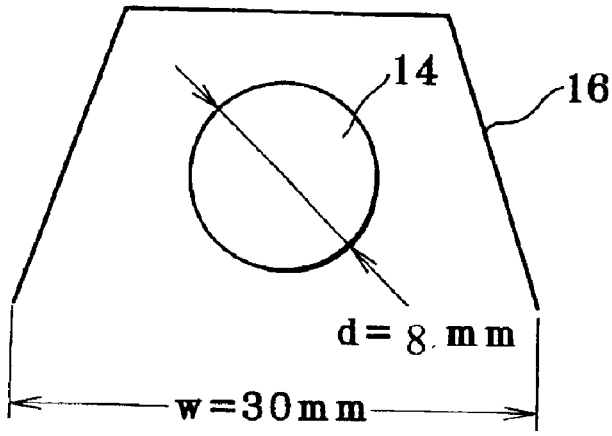
FIG. 3 is an explanatory view in elevation, illustrating a xenon flash lamp and a reflector in the photo fixer.

In FIG. 3, a diameter d of the xenon flash lamp 14 is approximately 8 mm. A width W of the reflector 16 is approximately 30 mm. Note that a diameter of a mercury fluorescent lamp according to the prior art is approximately 15 mm. A width of a reflector in combination with this is approximately 35–60 mm. Therefore, the use of the xenon flash lamp 14 is effective in reducing the printer size in comparison with the use of the mercury fluorescent lamp. As the size of the photo fixers is reduced, the time for the fixation can be shortened because of reduction in a distance of the feeding the recording material 3 in the fixation.

A UV absorbing filter 17 is disposed at the reflector 16 of the yellow photo fixer 9 in a form closing its front gap. In fixing the yellow color, the UV absorbing filter 17 as a fixation changeover unit absorbs and cuts a component of ultraviolet rays in a small range around a wavelength of 365 nm in correspondence with fixability of the magenta coloring layer, for the purpose of preventing fixation of the magenta coloring layer.

Figure 4:
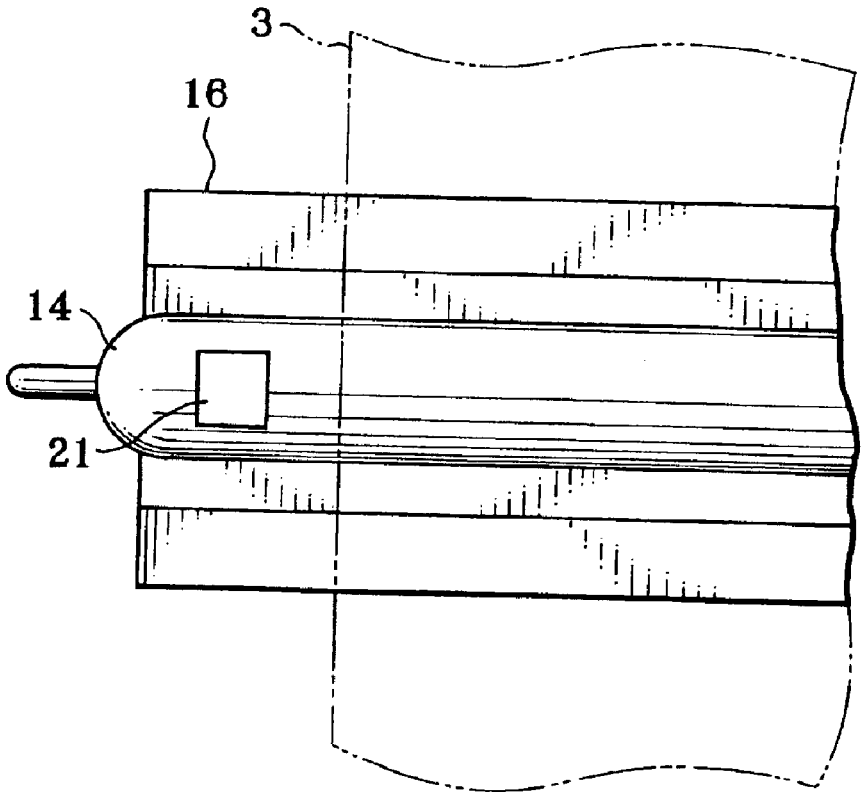
FIG. 4 is an explanatory view in plan, illustrating disposition of the xenon flash lamp and an irradiance sensor.

There is an irradiance sensor 21 opposed to each of the yellow and magenta photo fixers 9 and 11 for measuring irradiance of the yellow and magenta photo fixers 9 and 11. In FIG. 4, the irradiance sensor 21 is so positioned as to check an end portion of each of the yellow and magenta photo fixers 9 and 11. No blocking of rays occurs with the recording material 3 from the yellow and magenta photo fixers 9 and 11 to the irradiance sensor 21. The irradiance sensor 21 outputs a detection signal, according to which the amount of emitted rays of the yellow and magenta photo fixers 9 and 11 is controlled.

A controller 31 is connected with a motor driver 32, a printhead driver 33 and a lamp driver 34, and causes those to control various sections in the thermal printer 2. Also, a signal from the irradiance sensor 21 is input to the controller 31, which responsively controls an amount of fixing electromagnetic rays. The fixing ray amount is changeable by adjusting flashing frequency of turning on the xenon flash lamp 14.

The detection signal from the irradiance sensor 21 is in an analog form determined by the irradiance of the xenon flash lamp 14 at each one time of turning on. An A/D converter 23 is supplied with the detection signal, and converts the same into a digital signal. The digital signal is input to the controller 31. There is an arithmetic operation unit 27 in the controller 31.

Target irradiance Lt is predetermined and stored in a memory in the controller 31. The arithmetic operation unit 27 compares the target irradiance Lt with measured irradiance L(n) that is the output digital signal of the A/D converter 23. Note that a symbol n in the expression L(n) designates the number of times of turning on the xenon flash lamp 14. If the measured irradiance L(n) is different from the target irradiance Lt, the controller 31 redetermines the flashing frequency of the xenon flash lamp 14.

Let L(n) be a measured irradiance at the nth time of flashing of the xenon flash lamp 14. If measured irradiance L(n) is lower than a target irradiance Lt, then the flashing frequency f is set higher by adjustment. Thus, the interval between the nth and (n+1)th times of the flashing is shortened. The number of times of flashing per unit time becomes higher, to raise the fixing ray amount. In contrast, if the measured irradiance L(n) is higher than the target irradiance Lt, then the flashing frequency f is set lower by adjustment. Thus, the interval between the nth and (n+1)th times of the flashing is elongated. The number of times of flashing per unit time becomes lower, to reduce the fixing ray amount.

For the control of the fixing ray amount, the measurement of irradiance is started from the first time of flashing of the xenon flash lamp 14, and continued until the end of the fixation. The flashing frequency f is adjusted in a range of 10–20 Hz.

Figure 5:
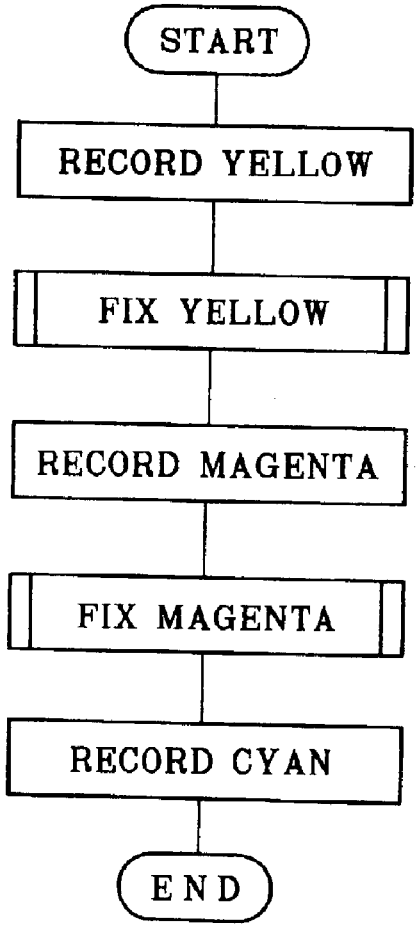
FIG. 5 is a flow chart illustrating thermal recording and fixation of the colors.
Figure 6:
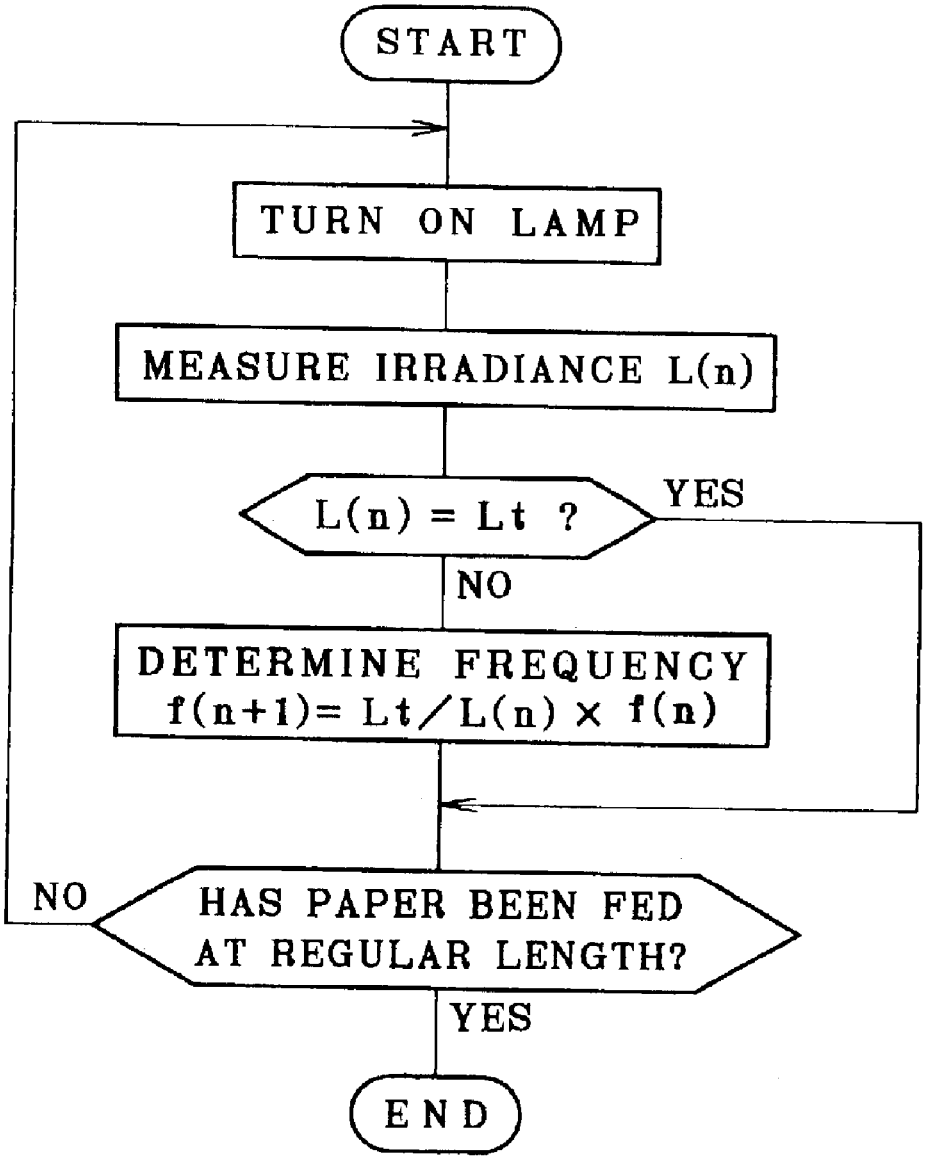
FIG. 6 is a flow chart illustrating a process of controlling an amount of the electromagnetic rays.

The operation of the above construction is described now with reference to flows in FIGS. 5 and 6. At first, a command signal for starting printing is input. The recording material 3 is fed in the forward direction for a first time. The thermal head 6 applies heat to the yellow coloring layer 46 to record a yellow image. A portion in the recording material 3 subjected to the yellow recording is moved past the yellow photo fixer 9. The yellow photo fixer 9 is turned on to fix the yellow coloring layer 46 electromagnetically.

Ultraviolet rays emitted by the yellow photo fixer 9 are passed through the UV absorbing filter 17, which absorbs components of the particular wavelength range associated with the magenta. It is possible safely to fix the yellow color without fixing the magenta coloring layer 44.

Upon the start of the yellow fixation of the yellow photo fixer 9, the control of the fixing ray amount of FIG. 6 is started. At first, frequency of the xenon flash lamp 14 is set at an initial frequency f(1). The xenon flash lamp 14 is turned on for a first flashing. An initial irradiance L(1) of the first flashing is measured by the irradiance sensor 21. The arithmetic operation unit 27 compares the initial irradiance L(1) with the target irradiance Lt. If the initial irradiance L(1) is found equal to this, then the controller 31 keeps the flashing frequency of the xenon lamp 14 unchanged. The xenon flash lamp 14 is turned on for a second flashing at an interval determined by the initial frequency f(1).

If in turn the measured irradiance L(1) is different from the target irradiance Lt, the flashing frequency is changed to the flashing frequency f(2). The xenon flash lamp 14 flashes for the second time upon a lapse of a duration defined according to the flashing frequency f(2). In response to this, the irradiance sensor 21 measures the target irradiance L(2), according to which the controller 31 controls the fixing ray amount by adjusting the flashing frequency. This control of the fixing ray amount is continued until the end of the yellow fixation after the recording material 3 is fed at the feeding speed V by a predetermined amount.

If there occurs degradation of the xenon flash lamp 14 with time to lower the irradiance in flashing of one time, it is possible to obtain a predetermined ray amount by raising the flashing frequency. No reduction in the feeding speed of the recording material 3 is required for keeping high ray amount. There occurs no drop in the efficiency due to elongated time for the fixation.

When the thermal recording and photo fixation of the yellow color are completed, the feeding roller set 8 comes to rotate in reverse to the initial direction. The recording material 3 is transported back to its initial position. While the recording material 3 is fed in the forward direction for the second time, the magenta color is thermally recorded and photochemically fixed. The process in FIG. 6 of controlling the fixing ray amount for the xenon flash lamp 14 is used in the magenta fixation in the same manner as the yellow fixation.

When the magenta recording and fixation are completed, the recording material 3 is transported backward to its initial position. Then the recording material 3 is transported in the forward direction for a third time. A cyan color is thermally recorded. There is no fixing operation of the cyan coloring layer 42, as the cyan coloring layer 42 does not have fixability in response to electromagnetic rays. It is to be noted that the recording material 3 can be constructed to have the cyan coloring layer 42 with the fixability in the same manner as the two remaining layers.

Figure 7:
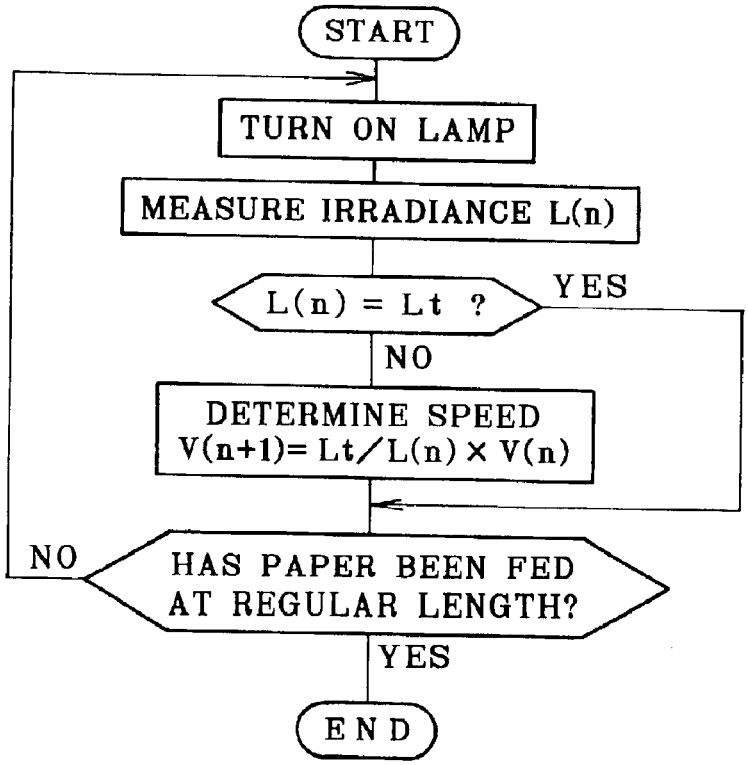
FIG. 7 is a flow chart illustrating a process similar to that of FIG. 6 but in which a feeding speed is adjusted.

In the above embodiment, the feeding speed for the recording material 3 is unchanged. To control the fixing ray amount, the flashing frequency of the xenon flash lamp 14 is adjusted. However, the feeding speed of the recording material 3 may be changed instead. In FIG. 7, a preferred embodiment is illustrated. The flashing frequency of the xenon flash lamp 14 is kept unchanged. For this construction, the irradiance is measured at each one time that the xenon flash lamp 14 flashes. According to the measured irradiance, the feeding speed is adjusted. Therefore, the magenta or yellow color can be fixed in a minimized time in accordance with the predetermined flashing frequency of the xenon flash lamp 14.

Figure 8:
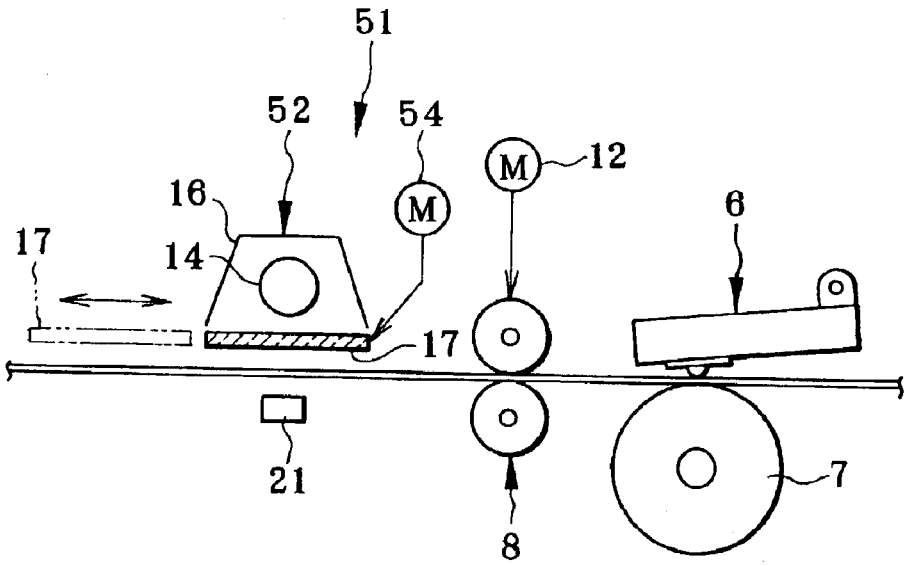
FIG. 8 is an explanatory view in elevation, illustrating a thermal printer including one xenon flash lamp and a movable filter.

In the above embodiment, the magenta photo fixer 11 is a separate device from the yellow photo fixer 9. However, a single photo fixer 52 can be used for fixing the yellow and magenta coloring layers. In FIG. 8, another preferred color thermal printer 51 is provided with the photo fixer 52 in which both of the yellow and magenta fixing components included in electromagnetic rays from the xenon flash lamp 14 are utilized by changing over the xenon flash lamp 14. Note that the use of the photo fixer 52 is additionally advantageous in that a distance of feeding the recording material 3 is shortened for the fixation, to shorten the time required for the fixation. Elements similar to those of the above embodiments are designated with identical reference numerals.

The photo fixer 52 includes the reflector 16, the xenon flash lamp 14 and the UV absorbing filter 17. The UV absorbing filter 17 is movable between a set position and an offset position, and when in the set position, is set between the xenon flash lamp 14 and the recording material 3, and when in the offset position, is offset from a region between the xenon flash lamp 14 and the recording material 3. A filter motor 54 as changeover mechanism in a fixation changeover unit moves the UV absorbing filter 17. For the yellow fixation, the UV absorbing filter 17 is shifted to the set position, and caused to absorb and cut the magenta fixing component included in the ultraviolet rays from the xenon flash lamp 14. For the magenta fixation, the UV absorbing filter 17 is shifted to the offset position.

Figure 9:
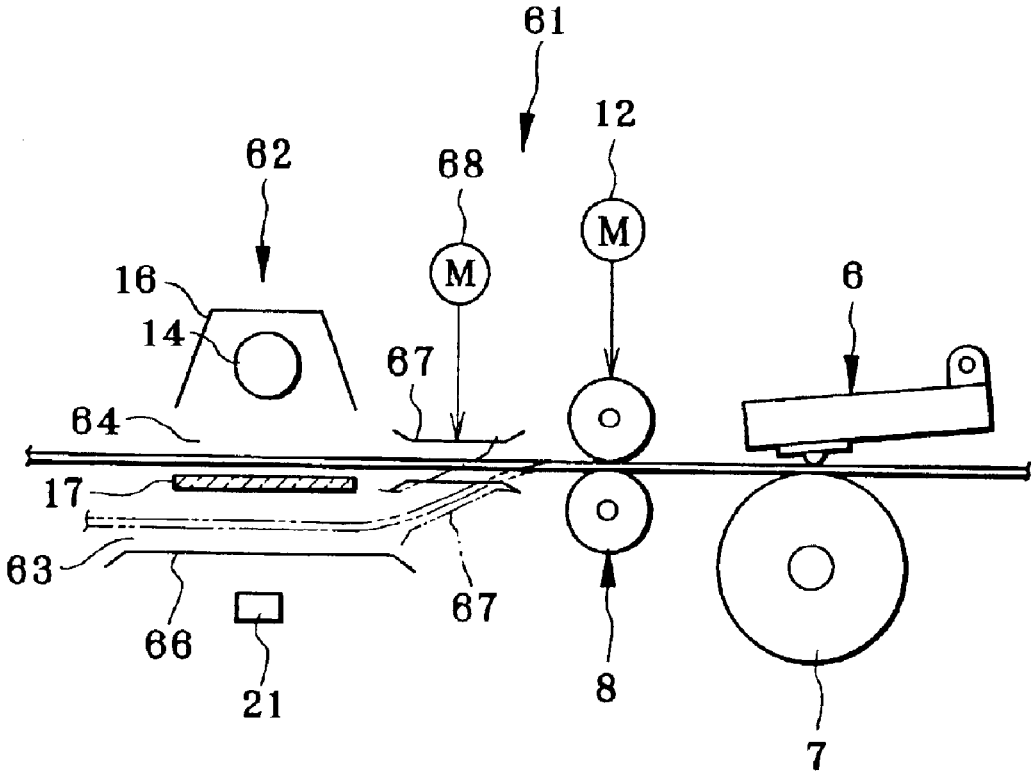
FIG. 9 is an explanatory view in elevation, illustrating another thermal printer including a xenon flash lamp, a filter and a path changeover structure for changing a filtering operation.

In FIG. 9, still another preferred color thermal printer 61 is depicted, and includes a variant structure for changing over a single photo fixer. The UV absorbing filter 17 is stationary. There are a first path 63 and a second path 64 between which the UV absorbing filter 17 is located.

The second path 64 for magenta fixation is disposed to extend between the xenon flash lamp 14 and the UV absorbing filter 17. A lower guide or support plate 66 is disposed under the UV absorbing filter 17. The first path 63 for yellow fixation extends between the UV absorbing filter 17 and the lower guide 66. A movable guide path 67 as a changeover mechanism in a fixation changeover unit is disposed between a photo fixer 62 and the feeding roller set 8. The movable guide path 67 is rotationally shiftable between first and second positions, and when in the first position, directs the recording material 3 toward the first path 63, and when in the second position, directs the recording material 3 toward the second path 64. A changeover motor 68 drives the movable guide path 67. The movable guide path 67 is displaced to change over the direction of the recording material 3.

In the above embodiments, the thermal printer is a one-printhead three-pass type in which the single thermal head is used and the recording material is transported for three times for full-color recording. However, a color thermal printer of the invention may be a three-printhead one-pass type in which three thermal heads are used and the recording material is transported for one time for full-color recording.

Figure 10:
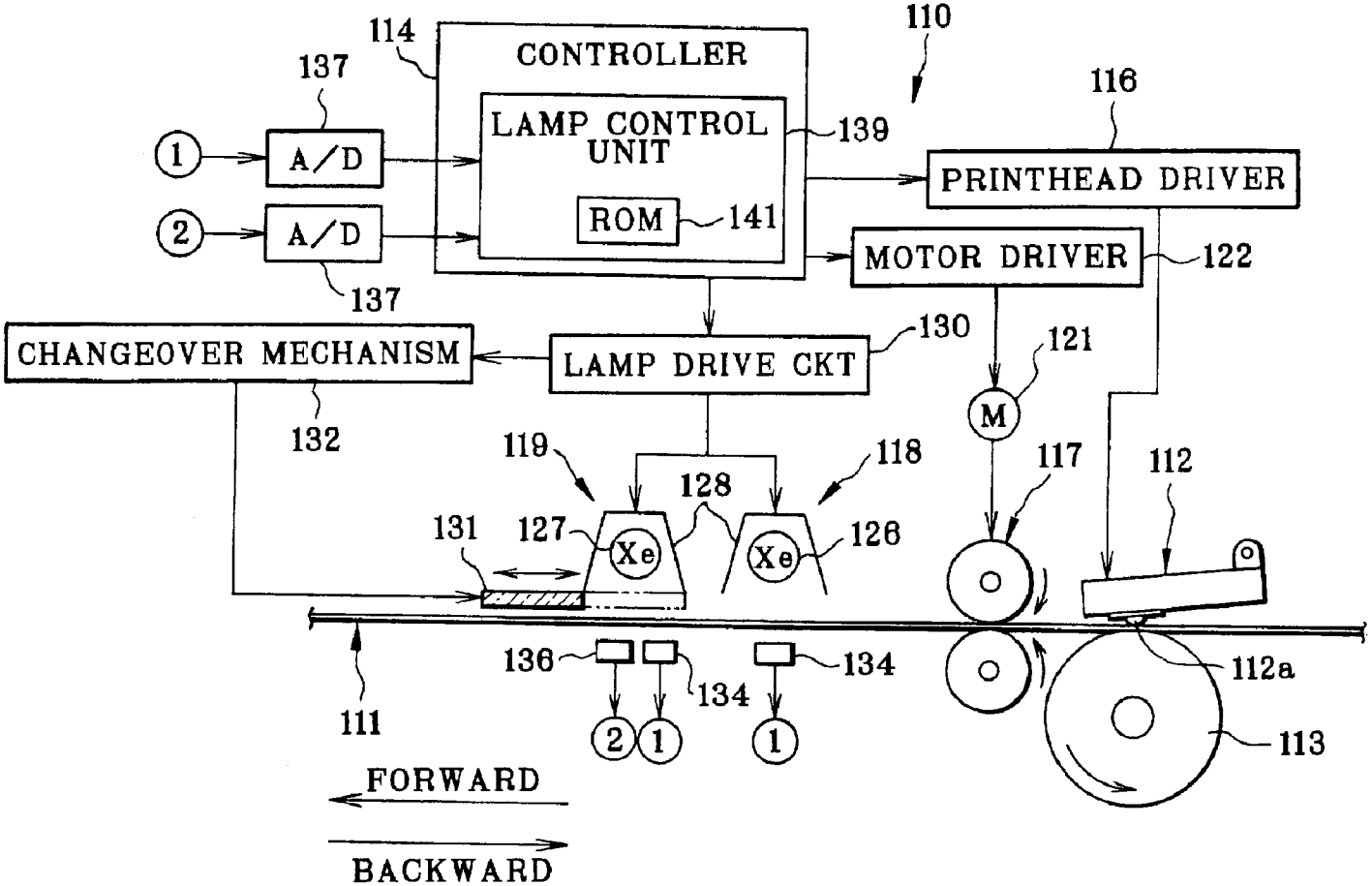
FIG. 10 is an explanatory view in elevation, illustrating a thermal printer in which a photo fixer has two lamps and one movable filter.
Figure 11:
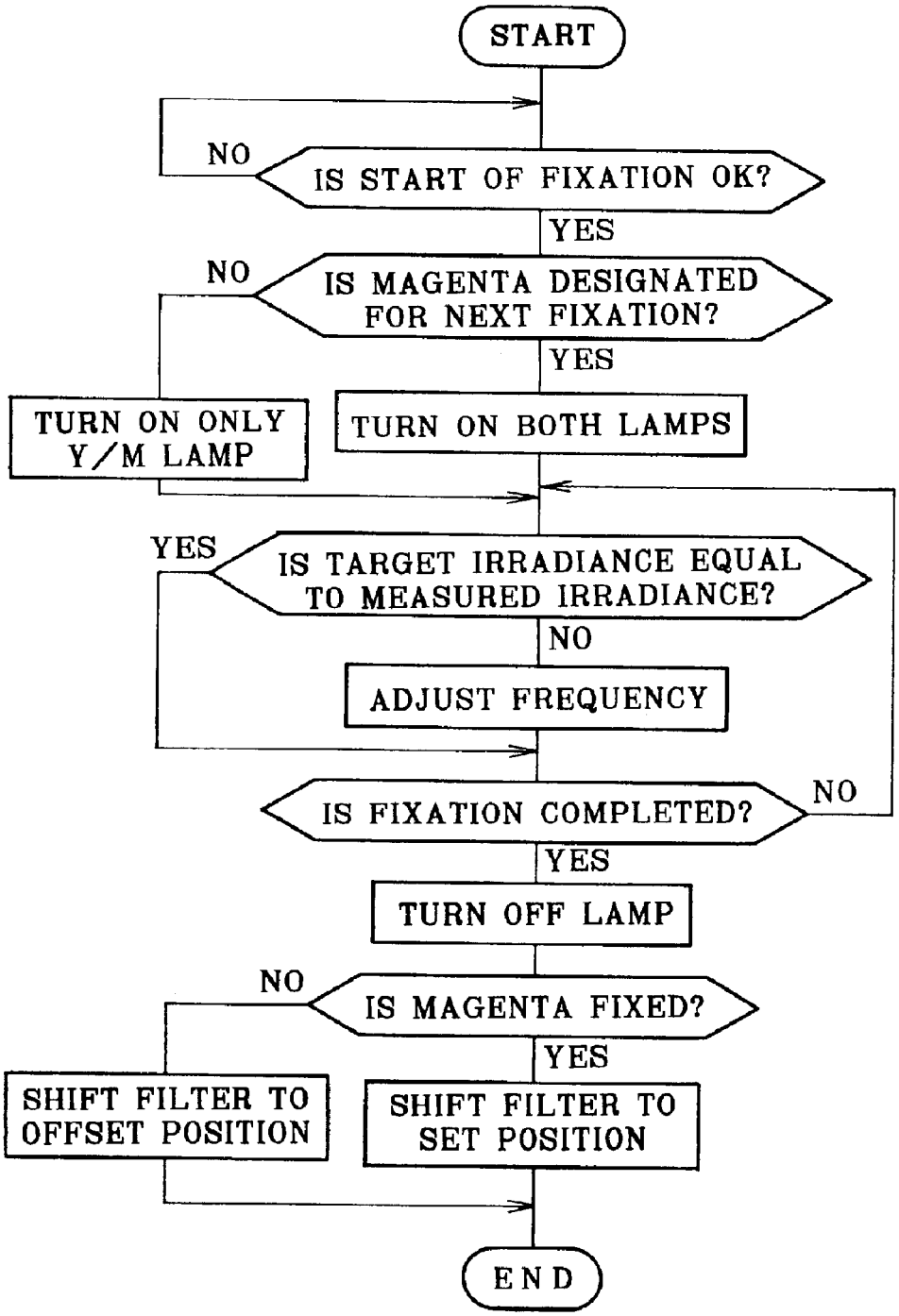
FIG. 11 is a flow chart illustrating operation of fixation of the photo fixer.

Another preferred embodiment is described with reference to FIGS. 10 and 11. In FIG. 10, a color thermal printer 110 is used with color thermosensitive recording material 111, which is transported forwards and backwards for thermal recording and photo fixation of a full-color image.

A thermal head 112 or printhead and a platen roller 113 are disposed in a feeding path for the recording material 111. The platen roller 113 is opposed to the thermal head 112, and supports the recording material 111. A heating element array 112*a* is included in the thermal head 112 as well-known in the art, and has a number of heating elements arranged in a main scan direction. A printhead driver 116 is connected with the thermal head 112. A controller 114 causes the printhead driver 116 to control the thermal head 112.

A feeding motor 121 is actuated for feeding the recording material 111. A motor driver 122 is caused by the controller 114 to drive the feeding motor 121.

A xenon flash lamp 127 as first electromagnetic wave source is combined with a xenon flash lamp 126 as second electromagnetic wave source. A lamp drive circuit 130 includes a main capacitor, with which the xenon flash lamps 126 and 127 are connected in parallel. A trigger electrode is positioned close to an outer surface of the glass tube of each of the xenon flash lamps 126 and 127. When a breakdown voltage is applied to the trigger electrode, discharge occurs in each of the xenon flash lamps 126 and 127 by passage of electric current from the main capacitor, to emit electromagnetic rays.

A magenta photo fixer 118 fixes the magenta coloring layer. A yellow/magenta photo fixer 119 is used to fix each of the yellow and magenta coloring layers. To fix the yellow color, only the xenon flash lamp 127 is turned on. To fix the magenta color, both of the xenon flash lamps 126 and 127 are turned on in view of the low sensitivity of the magenta coloring layer to electromagnetic rays.

Thus, the magenta fixing efficiency of the photo fixer is raised by simultaneously driving the xenon flash lamps 126 and 127. The feeding speed for the recording material 111 can be predetermined higher, to raise efficiency of the printing operation. Furthermore, the xenon flash lamp 127 can be also used for the yellow fixation. This keeps the printer size from being larger in comparison with a construction with one more magenta-specialized photo fixing lamp would be added. The sufficiently small printer size without being greater is advantageous in keeping a feeding distance in the fixation, and also time for the fixation without being longer.

A UV absorbing filter 131 is inserted between the yellow/magenta photo fixer 119 and the recording material 111 as a fixation changeover unit. A reflector 128 has a front gap, which is closed by the UV absorbing filter 131 when the UV absorbing filter 131 is in a set position. When the UV absorbing filter 131 is in an offset position, the reflector 128 comes away from the front gap. A changeover mechanism 132 is connected with the UV absorbing filter 131 to actuate the same. The changeover mechanism 132 is controlled by the controller 114 as the fixation changeover unit.

Flashing frequency of each of the xenon flash lamps 126 and 127 is adjusted by the controller 114 in consideration of the yellow and magenta coloring layers so as to keep the fixing ray amounts as required. There are magenta irradiance sensors 134 opposed to respectively the xenon flash lamps 126 and 127, for measuring irradiance of electromagnetic rays for the magenta fixation. There is a yellow irradiance sensor 136 opposed to the xenon flash lamp 127, for measuring irradiance of electromagnetic rays for the yellow fixation. The irradiance sensors 134 and 136 are so positioned as to check an end portion of the xenon flash lamps 126 and 127. No blocking of rays occurs with the recording material 111 from the xenon flash lamps 126 and 127 to the irradiance sensors 134 and 136.

An A/D converter 137 is connected with each one of the irradiance sensors 134 and 136. The irradiance sensors 134 and 136 respectively output an analog signal as detection signal according to the measured irradiance, and send it to the A/D converter 137.

A lamp control unit 139 has a ROM 141, which stores target irradiance of yellow and magenta fixing rays emitted for the fixation. In the yellow fixation, measured irradiance Ly from the yellow irradiance sensor 136 is compared with the target irradiance Ty for the yellow fixation. If there occurs inequality between those, then the flashing frequency of the xenon flash lamp 127 is adjusted to change the measured irradiance Ly to a level of the target irradiance Ty.

In the magenta fixation, values of the measured irradiance from the irradiance sensors 134 and 136 are added up to obtain a sum irradiance Lm. The sum irradiance Lm is compared with the target irradiance Tm for the magenta fixation. If there occurs inequality between those, then the flashing frequency of the xenon flash lamps 126 and 127 is adjusted to change the sum irradiance Lm to a level of the target irradiance Tm. This adjustment is effected at a predetermined interval and during a period from the beginning of the yellow and magenta fixation to the end of the fixation. So the fixing ray amount can be optimized to suppress irregularity in the fixation. Furthermore, no shortage in the fixation occurs even when degradation occurs to lower the irradiance in each time of flashing of the xenon flash lamp 126 or 127.

In operation of printing, the yellow recording and fixation are completed. The xenon flash lamp 126 is turned off. A feeding roller set 117 as feeder is rotated in the backward direction. The recording material 111 is transported in the backward direction and set back to the initial position. At the same time, the UV absorbing filter 131 is shifted to the offset position.

When the magenta recording and fixation are completed, then the xenon flash lamps 126 and 127 are turned off. The recording material 111 is transported back to the initial position. During this backward transport of the recording material 111, the UV absorbing filter 131 is shifted back to the set position. Upon coming back of the recording material 111 to the initial position, the recording material 111 starts being fed for a third time in the forward direction. A cyan color is recorded thermally. When the cyan recording is completed, the recording material 111 is exited.

It is to be noted that, in the above embodiment, the xenon flash lamps 126 and 127 are kept turned off while the recording material 111 is transported back. However, the xenon flash lamps 126 and 127 can be kept turned on while the recording material 111 is transported back. This can elongate time of continuing the flashing of the xenon flash lamps 126 and 127. Also, the feeding speed for the recording material 111 can be higher.

In the above embodiment, the xenon flash lamps 126 and 127 are used in the yellow/magenta photo fixer 119 and the magenta photo fixer 118. However, lamps of types other than the xenon flash lamps 126 and 127 may be used. A lamp for the yellow/magenta photo fixer 119 must emit rays including components for fixing the magenta and yellow colors. So preferable examples are a halogen lamp, a gas discharge lamp of an external electrode type, and the like. The gas discharge lamp includes a glass tube and a pair of electrodes. The glass tube has noble gas enclosed therein. The electrodes are disposed on the outside of the glass tube. In addition, any suitable type of lamp may be used if it has a broad spectral characteristic of emission in a range of approximately 365–420 nm. A lamp for the magenta photo fixer 118 should emit rays including the component for fixing the magenta color. Such a lamp may be a mercury fluorescent lamp for magenta.

In the above embodiment, the xenon flash lamp 126 in the magenta photo fixer 118 is structurally the same as the xenon flash lamp 127 in the yellow/magenta photo fixer 119. However, lamps of two different types may be used in combination. For example, a xenon lamp in the yellow/magenta photo fixer 119 may be combined with a mercury fluorescent lamp in the magenta photo fixer 118. A gas discharge lamp of an external electrode type in the yellow/magenta photo fixer 119 may be combined with a mercury fluorescent lamp in the magenta photo fixer 118.

In the above embodiment, the xenon flash lamp 126 in the magenta photo fixer 118 is single. The xenon flash lamp 127 in the yellow/magenta photo fixer 119 is single. However, each of the magenta photo fixer 118 and the yellow/magenta photo fixer 119 can accommodate two or more lamps. The number of lamps may be determined by considering a sufficient fixing ray amount.

Furthermore, electromagnetic wave sources in a photo fixer of the invention may be devices other than lamps, for example a Braun tube, and also a source including a great number of ultraviolet light-emitting diodes (LEDs) and phosphor combined therewith, for emitting ultraviolet and visible rays.

Figure 12:
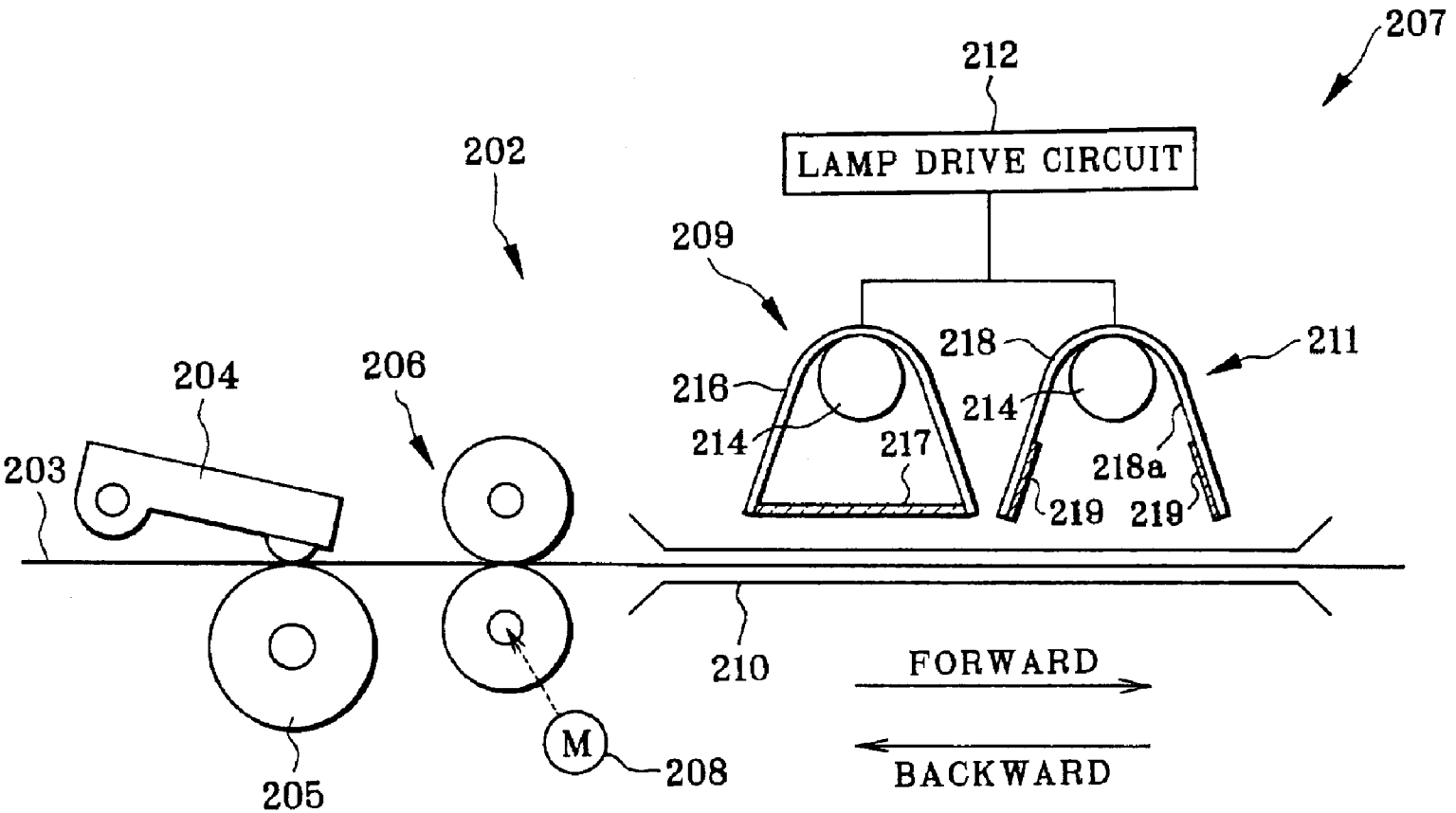
FIG. 12 is an explanatory view in elevation, illustrating another preferred thermal printer in which phosphor is added to a reflector of a photo fixer.

In FIG. 12, a preferred embodiment is illustrated, in which efficiency in emitting electromagnetic rays is improved by a coating of phosphor. A color thermal printer 202 is used with color thermosensitive recording material 203, which is transported in a forward direction and a backward direction, for thermal recording of a full-color image on the recording material 203 and for photo fixation of the recording material 203.

A thermal head 204 or printhead and a platen roller 205 are disposed in a feeding path for the recording material 203. The platen roller 205 is opposed to the thermal head 204, and supports the recording material 203.

A feeding roller set 206 as feeder is disposed in a feeding path and positioned downstream from the thermal head 204. Also, there is a photo fixer device 207. The feeding roller set 206 nips and feeds the recording material 203. A feeding motor 208 causes the feeding roller set 206 to rotate. There is a feeding guide mechanism 210 for regulating a direction of the recording material 203. The feeding guide mechanism 210 is formed from transparent plastic material for transmitting electromagnetic rays from the photo fixer device 207.

The photo fixer device 207 includes a yellow photo fixer 209, a magenta photo fixer 211, and a lamp drive circuit 212 as controller. The lamp drive circuit 212 drives the yellow and magenta photo fixers 209 and 211.

In the yellow photo fixer 209, there are a reflector 216 and a UV absorbing filter 217 in addition to a xenon flash lamp 214 as a fixation changeover unit.

Figure 13:
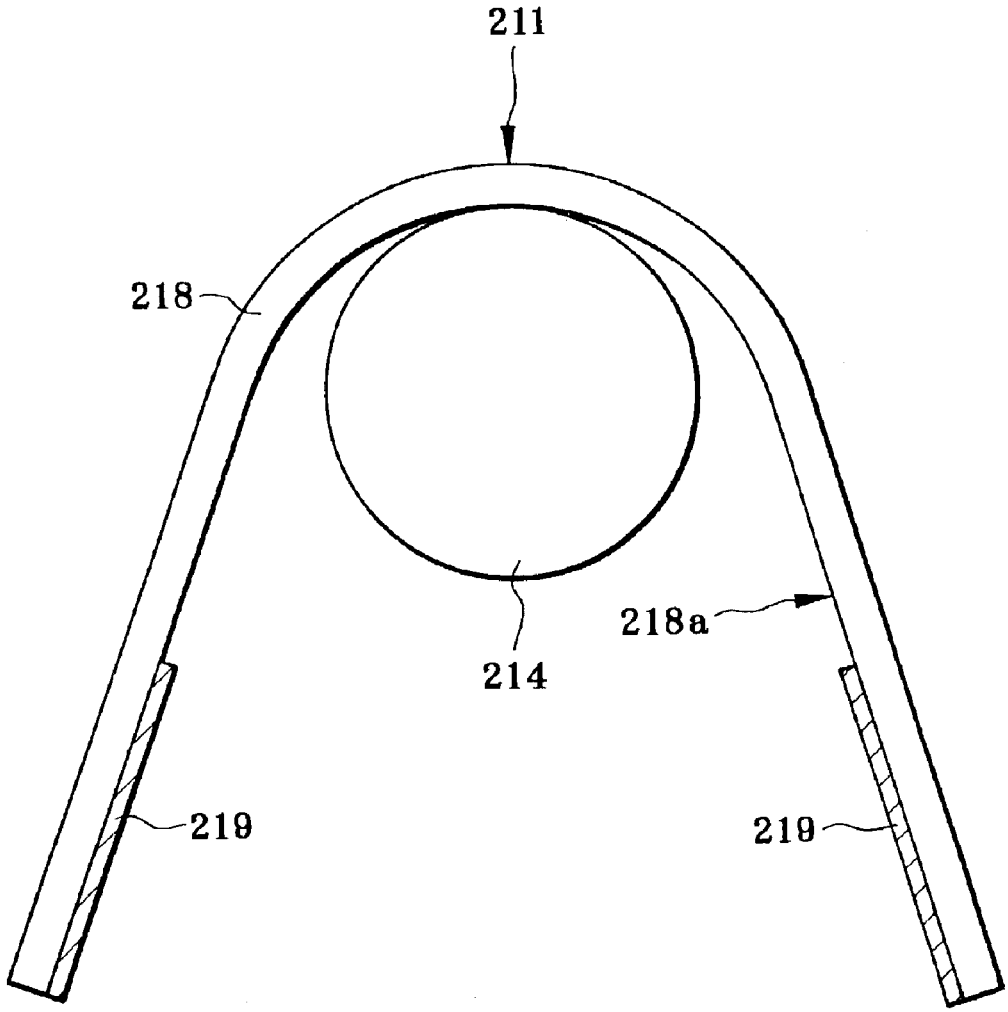
FIG. 13 is a side elevation illustrating the photo fixer.

In FIG. 13, the magenta photo fixer 211 includes the xenon flash lamp 214 and a reflector 218. The reflector 218 has a reflection surface 218*a*. There is phosphor 219 with which a portion of the reflection surface 218*a* is coated. The phosphor 219 has a characteristic as to, when electromagnetic rays of a certain very short wavelength are applied to it, emit rays in the wavelength range for the magenta fixation by excitation. In other words, the phosphor 219 converts the wavelength of electromagnetic rays.

Figure 14:
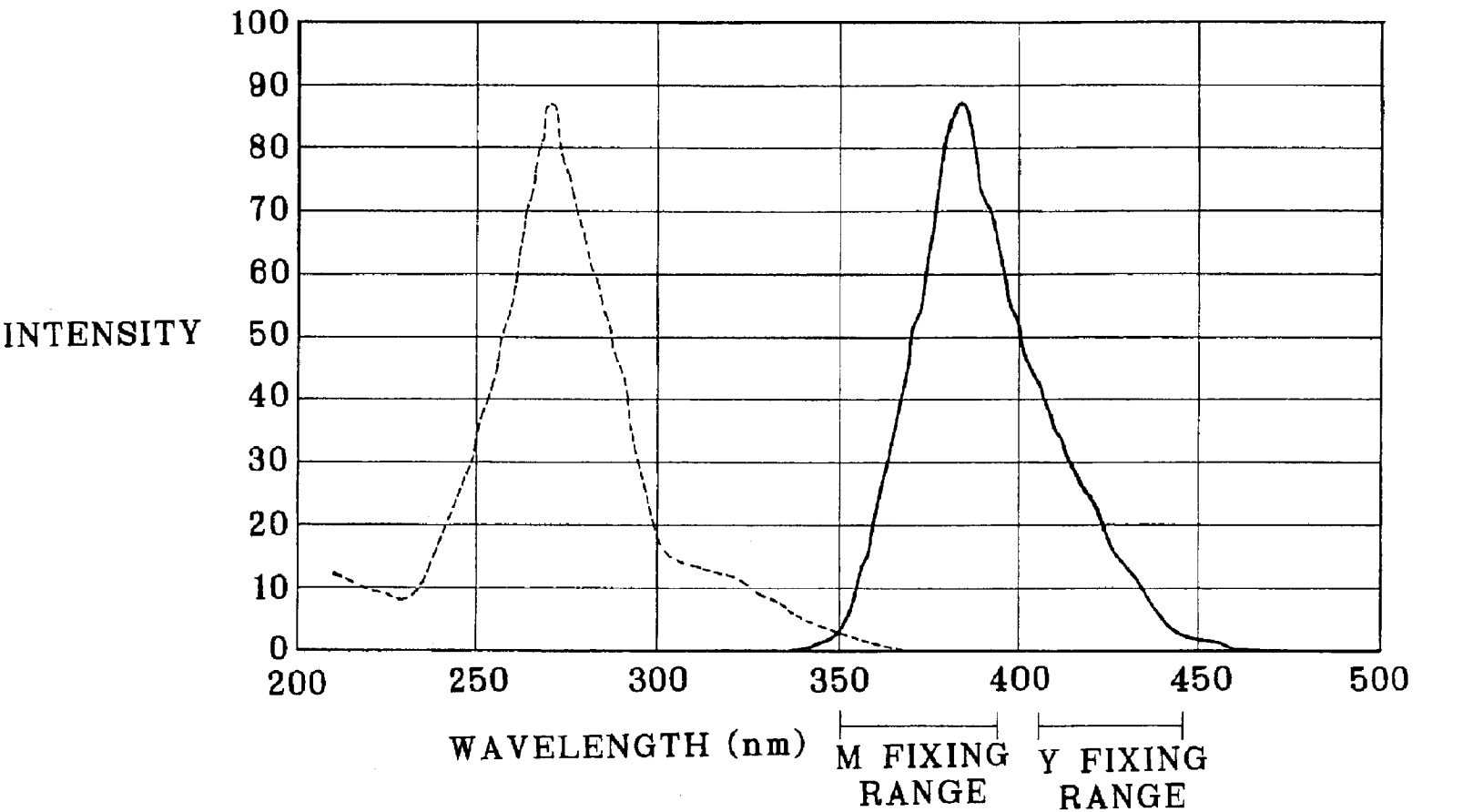
FIG. 14 is a graph illustrating an emission spectrum and an absorption spectrum of the phosphor.

An example of the phosphor 219 is photo-stimulated luminescence (PSL) material, of which a formula is BaFBr: $Eu^{2+}$, and which includes barium, fluorine, bromine, and divalent europium ion. In FIG. 14, spectra of absorption and emission of the phosphor 219 are illustrated. The absorption spectrum has a peak at a wavelength of approximately 265 nm. The emission spectrum has a peak at a wavelength of approximately 365 nm, which corresponds to the magenta coloring layer.

As is observed in the drawing, the curve of the absorption spectrum indicates very low absorption related to the magenta fixing rays. So the magenta fixing rays emitted by the xenon flash lamp 214 are reflected by the reflector 218, and applied to the recording material 203. In contrast, the phosphor 219 absorbs an ultraviolet component at a wavelength near to approximately 265 nm from electromagnetic rays emitted by the xenon flash lamp 214, and responsively emanates a magenta fixing component by excitation. The magenta fixing component is applied to the recording material 203 in addition to the component originally included in the rays directly emitted by the xenon flash lamp 214. The coating or film of the phosphor 219 on the reflector 218 raises the amount of the magenta fixing component to an extent of the excitation and emission of the phosphor 219. It is possible to raise the energy efficiency of the xenon flash lamp 214.

It is possible to economize the required electric energy by heightening efficiency. The life of the xenon flash lamp 214 is determined according to the number of times of flashing. The higher efficiency of energy makes it possible to reduce the number of times of flashing required for fixation of one image. Thus, the life of the xenon flash lamp 214 can be longer. If the xenon flash lamp 214 is flashed at the flashing frequency equal to that of a lamp which would not have the phosphor 219, irradiance of the xenon flash lamp 214 can be higher. This is effective in shortening the time required for the fixation. Also, the phosphor 219 absorbs electromagnetic rays of a short wavelength which would accelerate degradation of the plastic material. It is possible to reduce the degradation of plastic members such as the feeding guide mechanism 210 specifically in the vicinity of the xenon flash lamp 214.

In the present embodiment, the efficiency of energy is raised only regarding the magenta fixation. This is because the sensitivity of fixation for the magenta coloring layer is lower than that for the yellow coloring layer. Fixing rays of a higher amount must be applied according to smallness of the sensitivity of fixation. Note that it is conceivable to predetermine the flashing frequency of the magenta photo fixer 211 higher than that for the yellow photo fixer 209. However, there occur serious problems due to the two different values of flashing frequency. A structure of the lamp drive circuit become excessively complicated. Furthermore, there occurs a remarkable difference in the length of the lives of the yellow and magenta photo fixers 209 and 211.

In the embodiment, only the magenta photo fixer 211 is provided with the phosphor 219. This is to suppress a very great difference between the lives of the yellow and magenta photo fixers 209 and 211 in consideration of a difference between sensitivity magenta and yellow coloring layers in the fixation. It is noted that the yellow photo fixer may be provided with phosphor which can convert a certain component of electromagnetic rays from the xenon lamp into a yellow fixing component. This causes still higher efficiency in the energy.

Figure 15:
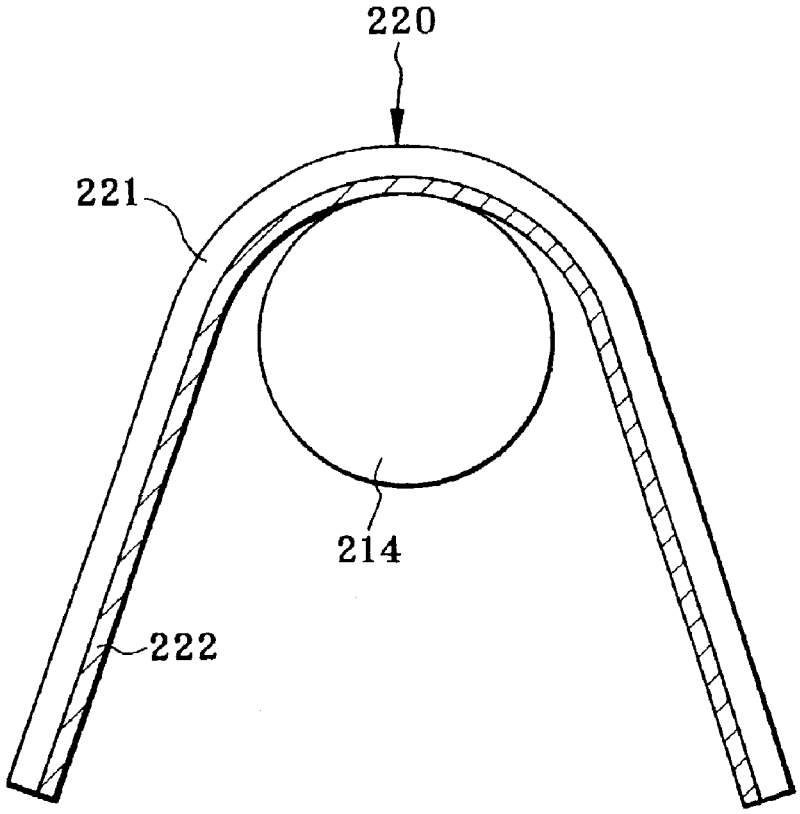
FIG. 15 is a side elevation illustrating another preferred photo fixer in which a film of phosphor is overlaid on the whole surface of a reflector.
Figure 16:
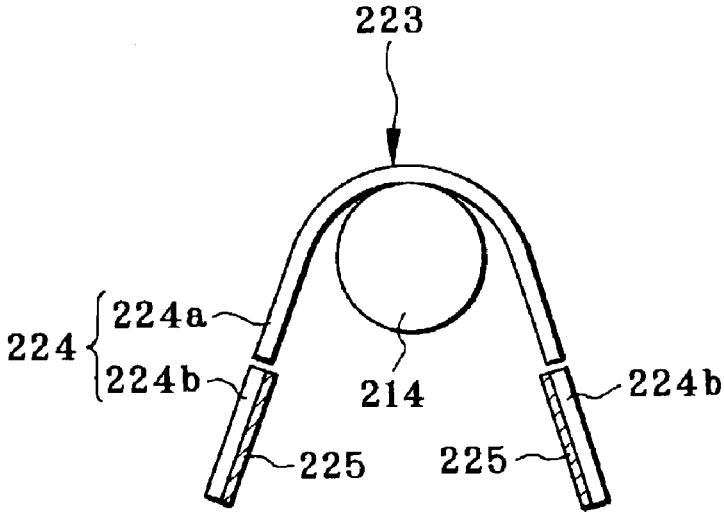
FIG. 16 is a side elevation illustrating still another preferred photo fixer with a reflector constituted by plural separate portions.

In the above embodiment, the reflector 218 is partially coated with the phosphor 219. In FIG. 15, another preferred embodiment is illustrated, in which a magenta photo fixer 220 has a reflector 221. There is a layer of phosphor 222 with which all of the inner surface of the reflector 221 is coated. In FIG. 16, another preferred magenta photo fixer 223 is depicted. A reflector 224 is constituted by a curved portion 224*a* or first part, and first and second front edge portions 224*b* or second parts. The front edge portions 224*b* extend from edges of the curved portion 224*a* in a skirt shape. Phosphor 225 is applied only to the front edge portions 224*b*. This makes it possible to produce the curved portion 224*a* without the phosphor 225 in one manufacturing line, and to produce the front edge portions 224*b* in a different line. Thus, the operation of production can be very easy. Note that, if there occurs failure in tight application of the phosphor 222 to the reflector 221, it is preferable to overlay a protective layer on a top surface of the phosphor for applying the phosphor 222.

In the above embodiment, the lamp according to the present invention is used in the photo fixer device in the color thermal printer. However, the lamp may be used as electromagnetic wave source of other purposes. To this end, phosphor of various characteristics, such as characteristics of absorption and emission, may be used.

Although the present invention has been fully described by way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. A thermal printer in which thermosensitive recording material is used, comprising:

a thermal head for recording an image by applying heat to said recording material; and a photo fixer for fixing said image by applying electromagnetic rays to said recording material, said photo fixer including at least one first xenon lamp, wherein said recording material comprises a first and a second coloring layer, wherein said first coloring layer is fixable upon application of said electromagnetic rays in a first wavelength range, and said second coloring layer is fixable upon application of said electromagnetic rays in a second wavelength range, and wherein said photo fixer further comprises a filter for cutting said electromagnetic rays in said second wavelength range in fixation of said first coloring layer.

2. A thermal printer in which thermosensitive recording material is used, comprising:

a thermal head for recording an image by applying heat to said recording material; and a photo fixer for fixing said image by applying electromagnetic rays to said recording material, said photo fixer including at least one first xenon lamp, wherein said recording material is color thermosensitive recording material, and includes a support, and at least first, second and third coloring layers, overlaid on said support, positioned in sequence from a printing surface toward said support, for developing respectively a predetermined color upon being heated;

said first coloring layer is fixable upon application of said electromagnetic rays in a first wavelength range, and said second coloring layer is fixable upon application of said electromagnetic rays in a second wavelength range;

said electromagnetic rays from said first xenon lamp are at least in said first and second wavelength ranges;

said photo fixer further includes a filter for cutting said electromagnetic rays in said second wavelength range in fixation of said first coloring layer.

3. A thermal printer as defined in claim 2, wherein a peak value of said first wavelength range is substantially 420 nm, and a peak value of said second wavelength range is substantially 365 nm.

4. A thermal printer as defined in claim 2, wherein said predetermined color of said first, second and third coloring layers is yellow, magenta and cyan.

5. A thermal printer as defined in claim 2, further comprising:

an irradiance sensor for measuring irradiance of said electromagnetic rays applied to said recording material; and a controller for controlling said electromagnetic rays to be emitted by said photo fixer according to said measured irradiance obtained by said irradiance sensor.

6. A thermal printer as defined in claim 5, wherein said controller divides a predetermined target irradiance by said measured irradiance, to obtain an irradiance ratio, multiplies predetermined frequency by said irradiance ratio, to obtain a target frequency, and drives said first xenon lamp by flashing at said target frequency.

7. A thermal printer as defined in claim 5, further comprising a feeder for feeding said recording material relative to said thermal head and said photo fixer;

said controller divides a predetermined target irradiance by said measured irradiance, to obtain an irradiance ratio, multiplies a feeding speed of said recording material by said irradiance ratio, to obtain a target feeding speed, and drives said feeder to feed said recording material at said target feeding speed.

8. A thermal printer as defined in claim 2, wherein said filter is slidable, and set between said first xenon lamp and said recording material in fixing said first coloring layer, and offset from between said first xenon lamp and said recording material in fixing said second coloring layer.

9. A thermal printer as defined in claim 2, wherein a first path is defined between said filter and said first xenon lamp, and a second path is defined so that said filter is disposed between said second path and said first xenon lamp, and said recording material passes said second path in fixing said first coloring layer, and passes said first path in fixing said second coloring layer.

10. A thermal printer as defined in claim 2, wherein said photo fixer further includes a second xenon lamp;

said filter is disposed in front of said first xenon lamp, said first xenon lamp is driven in fixing said first coloring layer;

said second xenon lamp is driven in fixing said second coloring layer.

11. A thermal printer as defined in claim 10, further comprising:

a reflector disposed to extend along a periphery of said second xenon lamp, having a reflection surface for reflecting electromagnetic rays in a forward direction upon emission from said second xenon lamp; and phosphor, formed on at least a portion of said reflection surface, for converting electromagnetic rays different from said second wavelength range into electromagnetic rays of said second wavelength range.

12. A thermal printer as defined in claim 4, wherein said photo fixer further includes a second xenon lamp;

said filter is disposed movably in front of said first xenon lamp;

in fixing said first coloring layer, said first xenon lamp is driven with said filter kept in front of said first xenon lamp;

in fixing said second coloring layer, said first xenon lamp is driven with said filter kept offset from said first xenon lamp, and also said second xenon lamp is driven.

13. A thermal printer in which color thermosensitive recording material is used, said recording material including a support, and first, second and third coloring layers, overlaid on said support, positioned in sequence from a printing surface toward said support, for developing respectively a predetermined color upon being heated, wherein said first coloring layer is fixable upon application of electromagnetic rays in a first wavelength range, and said second coloring layer is fixable upon application of electromagnetic rays in a second wavelength range, said thermal printer comprising:

a first electromagnetic wave source for emitting electromagnetic rays in ranges including at least said first and second wavelength ranges;

a second electromagnetic wave source for emitting electromagnetic rays in ranges including at least said second wavelength range;

a filter for absorbing a component of said second wavelength range in said electromagnetic rays, and for transmitting a component of said first wavelength range therein;

a moving mechanism for moving said filter relative to a front position in front of said first electromagnetic wave source;

in fixing said first coloring layer, said filter is set in front of said first electromagnetic wave source, to drive said first electromagnetic wave source, and in fixing said second coloring layer, said filter is offset from said front position of said first electromagnetic wave source, to drive said first and second electromagnetic wave sources.

14. A thermal printer as defined in claim 13, wherein said first and second electromagnetic wave sources comprise xenon flash lamps.

15. A thermal printer as defined in claim 13, wherein a peak value of said first wavelength range is substantially 420 nm, and a peak value of said second wavelength range is substantially 365 nm.

16. A thermal printer as defined in claim 14, further comprising:

an irradiance sensor for measuring irradiance of said electromagnetic rays applied to said recording material; and a controller for controlling said electromagnetic rays to be emitted by said xenon flash lamps according to said measured irradiance obtained by said irradiance sensor.

17. An electromagnetic wave source device comprising:

an electromagnetic wave source for emitting electromagnetic rays in ranges including at least first and second wavelength ranges;

a reflector disposed to extend along a periphery of said electromagnetic wave source, having a reflection surface for reflecting electromagnetic rays in a forward direction upon emission from a rear portion of said electromagnetic wave source; and phosphor, formed on at least a portion of said reflection surface, for converting electromagnetic rays of said first wavelength range into electromagnetic rays of said second wavelength range.

18. An electromagnetic wave source device as defined in claim 17, wherein said electromagnetic wave source comprises a xenon lamp.

19. An electromagnetic wave source device as defined in claim 17, wherein a peak value of said second wavelength range is substantially 365 nm.

20. An electromagnetic wave source device as defined in claim 17, wherein said phosphor comprises photostimulated luminescence (PSL) material.

21. An electromagnetic wave source device as defined in claim 17, wherein said reflector has a U-shape as viewed in section, and includes:

a curved portion disposed to extend along at least a portion of a periphery of said lamp; and first and second skirt portions, disposed to extend in said forward direction from said curved portion.

22. An electromagnetic wave source device as defined in claim 21, wherein said first and second skirt portions are coated with said phosphor.

23. An electromagnetic wave source device as defined in claim 21, wherein said skirt portions are originally separate from said curved portion, and secured thereto.

24. An electromagnetic wave source device as defined in claim 17, in which a thermosensitive recording material is used, wherein said electromagnetic wave source is adapted for photo fixation of color thermosensitive recording material;

wherein said recording material includes a support, and at least first, second and third coloring layers, overlaid on said support, positioned in sequence from a printing surface toward said support, for developing respectively a predetermined color upon being heated;

said first and second coloring layers are fixable upon application of said electromagnetic rays in respectively particular wavelength ranges.

25. A thermal printer in which a color thermosensitive recording material is used, said recording material comprising first and second coloring layers, wherein said first coloring layer is fixable upon application of electromagnetic rays in a first wavelength range, and said second coloring layer is fixable upon application of electromagnetic rays in a second wavelength range, said thermal printer comprising:

a first electromagnetic wave source for emitting electromagnetic rays in ranges including at least said first and second wavelength ranges;

a second electromagnetic wave source for emitting electromagnetic rays in ranges including at least said second wavelength range; and a filter for absorbing a component of said second wavelength range in said electromagnetic rays, and for transmitting a component of said first wavelength range therein.

26. A thermal printer according to claim 13, wherein at least one of said first electromagnetic wave source and said second electromagnetic wave source comprises a xenon flash lamp.

* * * * *